US006303912B1

(12) United States Patent
Eskildsen

(10) Patent No.: US 6,303,912 B1
(45) Date of Patent: Oct. 16, 2001

(54) INDUCTION HEATING KITCHEN APPLIANCE AND SYSTEM FOR USE

(75) Inventor: Christian Eskildsen, Gelsted (DK)

(73) Assignee: Aktiebolaget Electrolux, Stockholm (SE)

( * ) Notice: Subject to any disclaimer, the term of this patent is extended or adjusted under 35 U.S.C. 154(b) by 0 days.

(21) Appl. No.: 09/380,349

(22) PCT Filed: Mar. 13, 1998

(86) PCT No.: PCT/DK98/00095

§ 371 Date: Oct. 14, 1999

§ 102(e) Date: Oct. 14, 1999

(87) PCT Pub. No.: WO98/41060

PCT Pub. Date: Sep. 17, 1998

(30) Foreign Application Priority Data

Mar. 13, 1997 (DK) ..... 1997 0280

(51) Int. Cl.[7] ..... H05B 6/12

(52) U.S. Cl. ..... 219/622; 219/624; 219/662; 219/647; 99/DIG. 14

(58) Field of Search ..... 219/622, 623, 219/624, 626, 665, 662, 647; 99/DIG. 14, 325

(56) References Cited

U.S. PATENT DOCUMENTS

| | | | | |
|---|---|---|---|---|
| 2,415,853 | * | 2/1947 | Shaw | 219/624 |
| 3,740,513 | * | 6/1973 | Peters, Jr. et al. | 219/622 |
| 4,129,767 | * | 12/1978 | Amagami et al. | 219/626 |
| 4,456,807 | * | 6/1984 | Ogino et al. | 219/626 |
| 4,910,372 | * | 3/1990 | Vukich | 219/622 |
| 5,580,594 | * | 12/1996 | Matsumoto | 219/622 |

FOREIGN PATENT DOCUMENTS

| | | | |
|---|---|---|---|
| 1-189888 | * | 7/1989 | (JP) . |
| 2-162680 | * | 6/1990 | (JP) . |
| WO 94/05137 | * | 3/1994 | (WO) . |

* cited by examiner

*Primary Examiner*—Philip H. Leung
(74) *Attorney, Agent, or Firm*—Pearne & Gordon LLP

(57) ABSTRACT

An induction heating appliance has magnetically active parts on the top and is otherwise completely encapsulated in an electrically insulating and heat conductive material. The electrical connection is by means of a plug. A number of such appliances may be supplied with power in the range 20 kHz–100 kHz via coaxial cables leading to a central power supply converter. The unit is intrinsically safe and can be either installed or free standing.

5 Claims, 1 Drawing Sheet

INDUCTION HEATING KITCHEN APPLIANCE AND SYSTEM FOR USE

Figure 1:
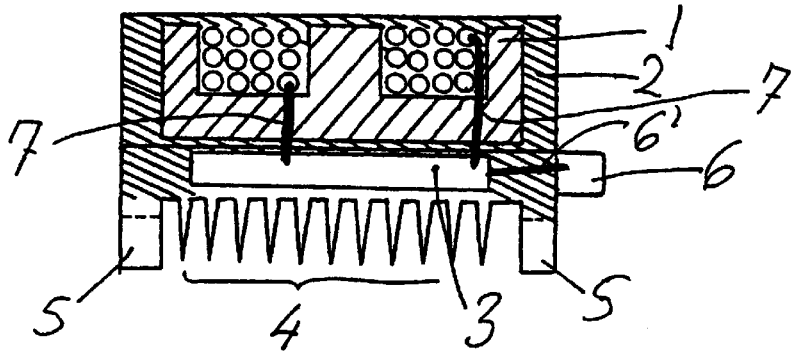

The invention relates to an induction heating appliance for heating kitchen utensils and the like.

Gas burners which may be put on any heat tolerant surface are well known as are electric cookplates which are available, not only when disposed directly in a cooktop but also singly, encased in a small cylindrical or boxlike container, either with controls on the front or simply switched on and off on the wall or by pulling the plug.

Induction heating elements are well known in the form of a component in a cooktop. They normally consist of a coil in a suitable fixture and optionally a set of ferrite rods disposed on the lower side. The connections to the coil are normally loose wires. In similarity with a motor for e.g. a dishwasher such a component is raw and unfit for immediate use by a consumer—it has to be installed properly first. In this way, the consumer is protected from direct access to parts which carry high voltages or have a high temperature.

With the increasing use of induction heating for the preparation of food there is a growing need for an induction heating element which takes the form of a kitchen appliance so that in can be moved around or placed in a closet when not in use. There is, however, presently no free-standing unit available, and the reason may be that the power convertor from mains voltage to ELF (i.e. 20 kHz–100 kHz) may be a bulky piece of apparatus which it is easier to accomodate inside a hob than inside a free-standing unit.

According to the invention there is provided an induction heating apparatus which not only is free-standing as a kitchen appliance but which also avoids the complex and bulky enclosure known from free-standing electric hotplates. This is obtained in that the coil of the appliance is disposed inside a dishshaped core structure, and that a heat tolerant electricaly insulating protective filler is cast around the coil, essentially filling all voids within the dish-shaped core structure. Thereby the core and coil constitute one solid and integrated structure. Such a unit is perfectly safe from a consumer viewpoint in that it provides no access to hot surfaces or dangerous voltages. This also means that such a unit may be built into any relevant cooktop without the need for review or approval by consumer protection authorities. Typically the core structure can be manufactured in a material such as densit (Trade Mark Aalborg Portland) with ferromagnetic particles or in an artificial resin having such particles. Similarly, the electrically protective filler can be made of densit, or alternatively in an artificial resin loaded with particles which contribute to heat conduction without providing electrical conductivity.

In an advantageous embodiment, a solid-state power converter is integrated into the coil and core structure by casting in the heat tolerant protective filler, having heat radiating fins facing downwards, the leads connecting the power converter to the mains being terminated in a mains socket of the appliance type. In this manner there is obtained a completely self-contained unit which a functionality which is similar to that of an electric hotplate. Similarly, the coil and core structure may be used to energize other kitchen utensils whereby the inductive energy is tapped and converted to a drive voltage for the kitchen appliance.

In a further advantageous embodiment the connections to the coil terminate in a plug which is fitted to the coil and core structure. In this manner no leads are left dangling.

In a use of the preceding embodiment, the terminating plug is supplied with ELF via a coaxial connection to a remote power supply converter. This provides for an installation where all protective circuitry, etc. is fitted inside the power supply converter, so that all that links the induction heating unit to said power supply unit is a coaxial cable fitted with suitable plugs.

In a further advantageous embodiment, the power supply converter is designed to provide ELF energy to a predetermined number of induction heating heating units via plugs and coaxial cables. This means that the house wiring system may provide not only wires carrying ordinary mains electricity, telephone wires and television signals, but similarly ELF power for particular outlets for use with induction heating units.

In a further advantageous embodiment, the controls for each individual induction heating unit are placed in the units themselves and communicate with the central power supply converter by means of signals carried simultaneously on the coaxial wire system. In this manner, the only connection between the individual induction heating units occurs via the coaxial cable.

In a further advantageous embodiment, the central power supply converter comprises means for determining the load condition for each individual induction heating unit and means for reducing or removing power from the unit in case the load condition indicates that the generated inductive field has a large stray field component. In this manner, the inductive heating units are intrinsically safe from incorrect use.

Figure 2:
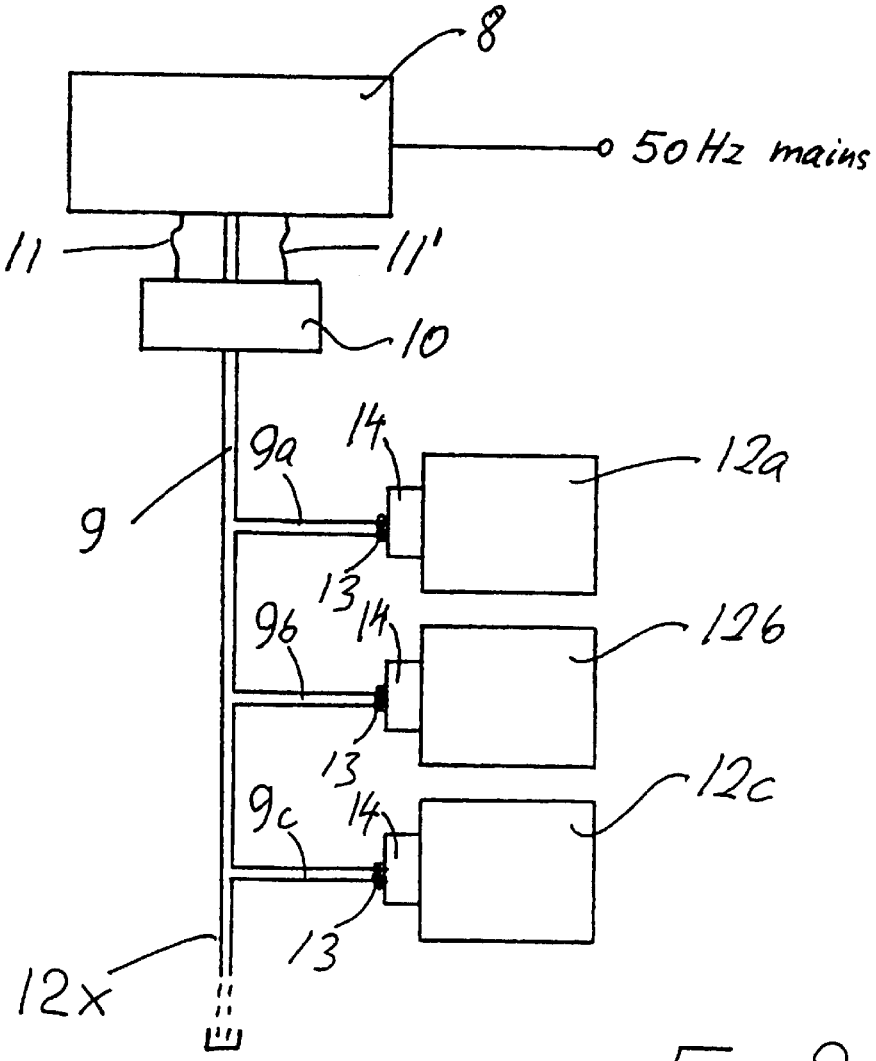

The invention will be described in greater detail with reference to the drawings, in which FIG. 1 shows a free-standing induction heating unit with a plug connection, and FIG. 2 shows a distribution system for ELF energy to a number of induction heating units.

In FIG. 1 is shown a free standing induction heating unit comprising an induction coil-and-core structure 1 which is disposed inside a shell 2 in an insulating and heat tolerant material. The core part is indicated by means of coarse hatching, and the individual windings of the coil is shown as a number of circles. A converter 3 from mains voltage and frequency to ELF energy in the range 20 kHz–100 kHz is provided below the core-and-coil structure and is in intimate contact with cooling fins 4 projecting below the converter 3 between supporting legs 5. The cooling fins 4 serve to cool the built-in converter. A standard kitchen appliance socket 6 is fitted to the side of the unit for receiving a plug at the end of a standard cable for connection to the mains. The socket is connected to the converter by means of the lead 6'. Controls which are not shown are connected to the converter 3 in order to adjust the heating of a load with a ferromagnetic component, and safety devices are connected to prevent accidental generation of ELF energy if there is no suitable load. The converter 3 is connected to the coil by means of leads 7 which may terminate in a plug-and-socket connection on the outside of the coil-and-core structure 1.

The supporting legs 5 are structured such that they may either be removed or do not extend beyond the profile of the unit. This means that this type of unit may be used either free-standing or built in by a customer into a kitchen table as desired. The socket 6 may be fitted to the underside of the unit so that the unit will fit into a circular cavity made in a kitchen table. The unit is completely self-contained, and the built-in safety features plus the fact that no heat for heating food is generated in the unit itself rake it intrinsically safe to use by the private consumer. There are neither high voltages nor high temperatures present. This is a situation which would not occur with any other means for cooking food, and certification of the unit as such will enable it to be used in any situation. This construction is well adapted to the needs of the private user, in that it may be bought as a unit to be built into a kitchen environment of the user's choice.

A further elaboration on this concept is shown in FIG. 2 in which a central power supply converter 8 receives energy from the 50 or 60 Hz mains and converts into ELF energy. The converter is of the switching type and is able to supply a sufficient number of consumers of ELF energy. The energy is supplied via a coaxial cable 9 with branches 9*a*, 9*b*, 9*c* in order to have a complete shielding of the energy. The setup is very similar to the antenna feed for an ELF transmitter, however the distances are usually so small that a full wavelength is not realised in the cable. A load monitor and communication device 10, in effect measuring the complex load impedance (which may occur at other frequencies than that used for the transmission of power), is connected at the converter 8 with a control signal 11 feeding back to the converter. This is a safety feature which switches off, in case the impedance measurement shows that the load condition is outside the acceptable range.

In FIG. 2 three induction heating units are shown as 12*a*, 12*b*, 12*c*, all connected via coaxial plugs 13,and an extension of the coaxial cable 9 is shown as 12*x*. Between the coaxial plug 13 and the respective induction heating unit is shown a communicator and control box 14. This is the consumer's control of the heating unit which communicates with the power converter 8 by means of signals at frequencies different from the energy-providing frequency, via the coaxial cable 9 and its branches. The communication is received (and in two-way. communication transmitted) by the communication device 10 and via the cable 11' to the power converter. This communication enables power fluctuation control and power distribution between the heating units in case the total potential load by simultaneous application of the heating units would exceed the capability of the power converter or the mains supply respectively. It is hence possible to monitor the needs of a particular heating unit and to switch it in or out locally (i.e. a local relay connection or disconnection of the ELF energy) by means of two-way signalling between the power converter 8 (via the device 10) and the communicators 14 connected to the heating units 12*a*, 12*b*, 12*c*.

Removing a heating unit by disconnecting the coaxial plug, e.g. for cleaning purposes, is immediately detected as an abnormal loading condition by means of the impedance measurement, and either a specially supplied dummy coaxial connector may be fitted or else reconnection must occur before the power converter is again able to supply power.

As the distribution system with a central converter is intrinsically safe, this too is well adapted to the requirements of the private user, in that it may be bought as a kit to be assembled in a kitchen environment of the user's choice.

What is claimed is:

1. A free-standing induction heating appliance for heating kitchen utensils and the like, in which the coil of the appliance is disposed inside a dish-shaped core structure, wherein a heat tolerant electrically insulating protective filler (2) is cast around the coil, essentially filling all voids within the dish- shaped core structure, and in which the connections to the coil terminate in a plug which is fitted to the coil and core structure (1); and wherein a solid-state power converter (3) is integrated into the coil and core structure (1) by casting in the heat tolerant protective filler (2), having heat radiating fins (4) facing downwards, the leads connecting the power converter to the mains being terminated in a mains socket of the appliance type.

2. An induction heating appliance according to claim 1, characterised in that the terminating plug is supplied with energy at a frequency of between 20 kHz and 100 kHz via a coaxial connection (9) to a remote power supply converter (8).

3. An induction heating appliance according to claim 2, characterised in that the power supply converter (8) is designed to provide energy at a frequency of between 20 kHz and 100 kHz to a predetermined number of induction heating units (12*a*, 12*b*, 12*c*) via plugs (13) and coaxial cables (9, 9*a*, 9*b*, 9*c*).

4. An induction heating appliance according to claim 3, characterised in that the controls (14) for each individual induction heating unit are placed in the units (12*a*, 12*b*, 12*c*) themselves and communicate with the central power supply converter (8) by means of signals carried simultaneously on the coaxial cables.

5. An induction heating appliance according to claim 4, characterised in that the central power supply converter (8) comprises means (10) for determining the load condition for each individual induction heating unit (12*a*, 12*b*, 12*c*) and means for reducing or removing power from the unit in case the load condition indicates that the generated inductive field has a large stray field component.

* * * * *